US005763126A

United States Patent [19]

Miyauchi et al.

[11] Patent Number: 5,763,126

[45] Date of Patent: Jun. 9, 1998

[54] ELECTROPHOTOGRAPHIC PHOTORECEPTOR AND PRODUCTION PROCESS FOR SAME

[75] Inventors: Masato Miyauchi, Nara; Kumiko Morita, Kashiba, both of Japan

[73] Assignee: Sharp Kabushiki Kaisha, Osaka, Japan

[21] Appl. No.: 636,805

[22] Filed: Apr. 23, 1996

[30] Foreign Application Priority Data

Jun. 1, 1995 [JP] Japan ..... 7-134955

[51] Int. Cl.[6] ..... G03G 5/05

[52] U.S. Cl. ..... 430/58; 430/96; 430/133

[58] Field of Search ..... 430/96, 58, 59, 430/133, 134

[56] References Cited

U.S. PATENT DOCUMENTS

| | | | |
|---|---|---|---|
| 3,877,935 | 4/1975 | Regensburger | 96/1.5 |
| 4,297,427 | 10/1981 | Williams et al. | 430/122 |
| 5,449,572 | 9/1995 | Ashiya et al. | 430/96 |
| 5,459,005 | 10/1995 | Kato et al. | 430/96 |
| 5,492,786 | 2/1996 | Sugimura et al. | 430/96 |
| 5,604,063 | 2/1997 | Endo et al. | 430/96 |

FOREIGN PATENT DOCUMENTS

| | | |
|---|---|---|
| 55-42380 | 10/1980 | Japan . |
| 59-214035 | 12/1984 | Japan . |
| 2-57300 | 9/1985 | Japan . |
| 4-78984 | 7/1987 | Japan . |
| 62-212660 | 9/1987 | Japan . |
| 62-267747 | 11/1987 | Japan . |
| 63-148263 | 6/1988 | Japan . |
| 1-206348 | 8/1989 | Japan . |
| 2-254464 | 10/1990 | Japan . |
| 6-59471 | 3/1994 | Japan . |
| 6-222580 | 8/1994 | Japan . |

*Primary Examiner*—John Goodrow

*Attorney, Agent, or Firm*—Nixon & Vanderhye, P.C.

[57] ABSTRACT

The present invention provides an electrophotographic photoreceptor having a uniform film, in which the electrical characteristics are not deteriorated over an extended period of time without causing abrasion, scratches and film defects on the surface of the photoreceptor by the contact with toner, a developer, paper and a cleaning blade and which can repeatedly be used. The electrophotographic photoreceptor has a conductive support and a photoconductive layer provided on the above conductive support, and the photoconductive layer contains a charge-generating material, a charge-transporting material and a binder resin having no or one glass transition point.

22 Claims, 2 Drawing Sheets

ELECTROPHOTOGRAPHIC PHOTORECEPTOR AND PRODUCTION PROCESS FOR SAME

BACKGROUND OF THE INVENTION (1) Field of the Invention

The present invention relates to an electrophotographic photoreceptor, more specifically to an electrophotographic photoreceptor which is improved in electrophotographic characteristics, and a production process for the same.

(2) Description of the Prior Art

Electrophotographic photoreceptors which have been put to practical use are classified into inorganic photoreceptors using inorganic materials and organic photoreceptors using organic materials.

Inorganic materials have so far been mainly used as the electrophotographic photoreceptors in terms of both the sensitivity and the durability. The typical examples of the inorganic photoreceptors include selenium series products comprising amorphous selenium (a-Se) and amorphous arsenic selenium (a-AsSe), products obtained by dispersing pigment-sensitized zinc oxide (ZnO) or cadmium sulfide (CdS) in binder resins, and products using amorphous silicon (a-Si). In the inorganic photoreceptors described above, however, the selenium series photoreceptors and the photoreceptors using CdS have problems in terms of the heat resistance and the storage stability. Further, since they are toxic, they have problems on dumping thereof and cause public pollutions. ZnO-dispersed-in-resin series photoreceptors are scarcely used at present because of low sensitivities and low durabilities thereof. Further, while a-Si series photoreceptors to which attentions are paid as a non-polluting inorganic photoreceptor have advantages such as a high sensitivity and a high durability, they have defects such as defective image originating in the production process thereof using plasma CVD and an increase in cost originating in the low productivity.

On the other hand, the representative examples of organic photoreceptors include ones using a charge-transfer complex of 4,7-trinitro-9-fluorenone (TNF) with polyvinylcarbazole (PVK) and double-layered photoconductive structures having a charge-generating layer and a charge-transporting layer. Since many kinds of organic materials are present, these organic photoreceptors, which have excellent storage stability and no toxicity, can be produced by suitably selecting the organic materials. Further, it is easy to form the thin films thereof by coating, and therefore the organic photoreceptors thereof can be produced at low costs. Since in recent years, it has been being attempted to enhance the durability, attentions are paid thereto as one of the most important photoreceptors. The PVK-TNF charge-transfer complex series organic photoreceptors described above have been improved in various manners but have not yet come to have sufficiently high sensitivities. On the other hand, the organic double-layered photoconductive structures have laminated structures comprising a layer containing a charge-generating material which generates charge carriers when irradiated with light (hereinafter referred to as a charge-generating layer) and a layer containing a charge-transporting material which accepts the charge carriers generated in the charge-generating layer and transports them (hereinafter referred to as a charge-transporting layer). They have relatively excellent sensitivities and occupy a leading position in the organic photoreceptors which have been put to practical use.

Known as the examples of these organic double-layered photoconductive structures are ones in which a thin film formed by applying an organic amine solution of chlorodian blue is used for a charge-generating layer and a hydrazone compound is used for a charge-transporting layer (Japanese Patent Publication No. Sho 55-42380), and ones comprising a charge-generating layer of a diazo compound and a charge-transporting layer of a hydrazone compound (Japanese Patent Application Laid-Open No. Sho 59-214035). Further, it is proposed to use anthanthrone and quinone series compounds, which are a kind of pigments, as a charge-generating material (U.S. Pat. No. 3,877,935). Such organic photoreceptors are produced by applying a photoconductive layer-forming solution on a conductive support to form a photoconductive layer. Known as production methods are a Baker applicator, a bar coater and the like when a support is a sheet, and a spray method, a vertical type ring method, and a dip-coating method when the support is a drum. In general, the dip-coating method is employed because of the simple apparatus.

However, the existing status is that while the conventional organic electrophotographic photoreceptors described above have sufficiently high performances with respect to the initial electrophotographic characteristics, the satisfactory performances have not yet been obtained in terms of durability in the electrical and mechanical characteristics. For example, in the electrical characteristics, the repeated use causes an increase in the residual potential and a reduction in the charge potential. Further, a photoreceptor has the problem that it comes into contact with toner, a developer, paper, a cleaning blade and the like in the apparatus and the surface of the photoreceptor is abraded and scratched, which result in causing toner filming and defective image. Further, ozone formed by corona discharge and slobbery stain on images caused by nitrogen oxides are problematic.

It has been found from investigations in the past that durability in the electrical and mechanical characteristics are closely related not only to the characteristics of charge-generating materials and charge-transporting materials but also to the characteristics of binder resins used for forming the photoconductive layers containing them. Accordingly, investigations of binder resins for a purpose of improving the characteristics required to electrophotographic photoreceptors such as abrasion resistance and sensitivity have resulted in proposing a method in which polycarbonate is used for a binder resin for a photoreceptor singly or in combination with similar polycarbonates, or a method in which polycarbonate is used in combination with other kinds of polymers.

That is, methods using specific polycarbonates are proposed in Japanese Patent Publication No. Hei 2-57300, Japanese Patent Application Laid-Open No. Sho 63-148263, Japanese patent Application Laid-Open No. Hei 2-254464, and Japanese patent Application Laid-Open No. Hei 6-59471. While polycarbonate alone provides the good electrical characteristics, it does not allow an improvement in abrasion resistance which exhibits the durability in the mechanical characteristics to be expected. Further, increasing the molecular weight of polycarbonate in order to enhance the abrasion resistance deteriorates the compatibility with charge-transporting materials and therefore deposits the charge-transporting materials. Accordingly, white spots are formed on images, or because of a low solubility of polycarbonate itself, a part of insoluble matters remains in the film to form black spots on images. Further, the repeated use causes a photoconductive layer in this part to fall out and makes it unusable.

Further, proposed are several methods using two or more kinds of polycarbonates having different molecular weights as binder resins in order to improve the abrasion resistance. In any methods, however, the satisfactory performances have not been able to obtain. For example, proposed in Japanese Patent Publication No. Hei 4-78984 is an electrophotographic photoreceptor containing polycarbonate (1) having a number-average molecular weight of 15,000 or less and polycarbonate (2) having a number average molecular weight of 45,000 or more as resin components, wherein the content of the polycarbonate (1) is 30 to 95%. However, the use of polycarbonate having such a low molecular weight as a main component leads to lack in the strength in terms of an increase in the speed of a copying process in recent years and therefore does not provide the sufficiently high abrasion resistance. In contrast with this, proposed in Japanese Patent Application Laid-Open No. Hei 6-222580 is an electrophotographic photoreceptor as shown in the above example containing polycarbonate (1) having a weight-average molecular weight of 40,000 to 90,000 and polycarbonate (2) having a weight-average molecular weight of 100,000 or more as resin components, wherein the content of the polycarbonate (1) is 5 to 50%. However, the use of polycarbonates having such high molecular weights as main components deteriorates the compatibility with charge-transporting materials and therefore deposits the charge-transporting materials as shown in the above example. Accordingly, white spots are formed on images, or because of a low solubility of polycarbonate itself, a part of insoluble matters remains in the film to form black spots on images. In addition to the above, proposed in Japanese Patent Application Laid-Open No. Hei 1-206348 is an electrophotographic photoreceptor containing polycarbonate (1) having a number average molecular weight of 20,000 to 40,000 and polycarbonate (2) having a number-average molecular weight of 40,000 to 65,000 as binder resin components, wherein the content of the polycarbonate (1) is 5 to 50%. However, mixing merely two kinds of such polycarbonates as having molecular weight distributions close to each other provides nothing but the abrasion resistance equivalent to that of polycarbonate having a molecular weight of about 40,000.

Further, it is proposed to use a copolymer or a mixture of polycarbonate and polyester or polyarylate as a binder resin for purposes of enhancing the compatibility with charge-transporting materials and improving various characteristics. For example, proposed in Japanese Patent Application Laid-Open No. Sho 62-212660 is an electrophotographic photoreceptor containing 95 to 50 parts by weight of polycarbonate and 5 to 50 parts by weight of polyarylate and/or polyester as binder resin components. However, while the abrasion resistance and the compatibility with charge-transporting materials are improved when polycarbonate having a high abrasion resistance and a large molecular weight is mainly used, the electrical characteristics have been deteriorated. Further, there exist the defects that in the composition of such resins as deteriorating the electrical characteristics, a coating solution used in forming a thin film by an applying method such as bar coating and dip-coating or other methods such as spraying causes separation and gelation during use which make it impossible to stand prolonged use.

Further, proposed in Japanese Patent Application Laid-Open No. Sho 62-267747 is an electrophotographic photoreceptor containing a copolymer of polycarbonate and polyester as a resin component. While copolymers improve the electrical characteristics and the abrasion resistance, it is impossible or difficult in many cases to synthesize the copolymers in the synthetic processes, or if can be synthesized, they become very expensive as compared with merely mixing them and are therefore disadvantageous.

Further, in recent years, the number of printable sheets in a machine such as copying machines, printers, and plain paper facsimiles has been increased, and an increase in the speed has been going on. Accordingly, an enhancement in durability in the electrical and mechanical characteristics of photoreceptors has been increasingly required. That is, as an increase in the speed goes on, the process speed increases, which in turn is liable to increase flying of toners and cause defective cleaning. As a countermeasure therefor, it has been attempted in some kinds of machines to employ a double cleaning blade or raise the pressing pressure thereof. Accordingly, the existing status is that since the abrasion has been increased, only conventional improvements increase the abrasion and can not provide sufficiently effective countermeasures. Further, several methods are proposed in which over coating layers are provided. However, the application thereof makes it difficult to select solvents which do not solve a photoconductive layer already applied and shall exert an adverse effect on the electrical characteristics after finishing the application, which makes it difficult how to put it to practical use.

As described above, commercially available among binder resins used for conventional photoreceptors are no binder resins having sufficiently satisfactory durability in the electrical and mechanical characteristics.

SUMMARY OF THE INVENTION

Accordingly, an object of the present invention is to provide an electrophotographic photoreceptor having a uniform film, in which the electrical characteristics are not deteriorated over an extended period of time without causing abrasion, scratches and film defects on the surface of the photoreceptor by the contact with toner, a developer, paper, and a cleaning blade and the like which can repeatedly be used, and a production process for the same.

According to one aspect of the present invention, provided is an electrophotographic photoreceptor, comprising: a conductive support; and a photoconductive layer provided on the above conductive support and containing a charge-generating material, a charge-transporting material and a binder resin having no or one glass transition point.

According to another aspect of the present invention, provided is an electrophotographic photoreceptor, comprising: a conductive support; a charge-generating layer provided on the above conductive support and containing a charge-generating material; and a charge-transporting layer provided on the above charge-generating layer and containing a charge-transporting material and a binder resin having no or one glass transition point.

According to still another aspect of the present invention, provided is a process for producing an electrophotographic photoreceptor, comprising the steps of: dipping a conductive support in a solution for a photoconductive layer containing a charge-generating material, a binder resin having no or one glass transition point and a solvent; pulling up the conductive support from the solution; and drying the conductive support to remove the solvent from the solution covering the surface of the support, thereby forming the photoconductive layer.

According to further another aspect of the present invention, provided is a process for producing an electrophotographic photoreceptor, comprising the steps of: dipping a conductive support having a charge-generating layer containing a charge-generating material on the surface of the support in a solution for a charge-transporting layer containing a charge-transporting material, a binder resin having no or one glass transition point and a solvent; pulling up the conductive support from the solution; and drying the conductive support to remove the solvent from the solution covering the surface of the charge-generating layer formed on the support, thereby forming a charge-transporting layer.

As described above, in a single layer type electrophotographic photoreceptor comprising a conductive support and a photoconductive layer, provided on the support, containing a charge-generating material, a charge-transporting material and a binder resin, or double-layered photoconductive structures (function-separated type electrophotographic photoreceptor) comprising a conductive support and a charge-generating layer as well as a charge-transporting layer, provided on the support, a resin mixture having no or only one glass transition point is used as a binder resin contained in the photoconductive layer or charge-transporting layer described above, whereby there can be obtained an electrophotographic photoreceptor having a uniform film, in which the electrical characteristics are not deteriorated over an extended period of time without causing abrasion, scratches and film defects on the surface of the photoreceptor by the contact with toner, a developer, paper, a cleaning blade and the like and which can repeatedly be used.

Further, in a solution for a photoconductive layer or a solution for a charge-transporting layer each used in the process producing an electrophotographic photoreceptor, a solution prepared by dissolving a binder resin having no or only one glass transition point in a solvent is employed, which makes it possible to use stably the solution over an extended period of time.

Further advantages and features of the present invention as well as the scope, nature and utilization of the present invention shall become apparent to those averagely skilled in the art from the descriptions of the preferred embodiments of the present invention set forth below.

DESCRIPTION OF THE PREFERRED EMBODIMENTS

Figure 1:
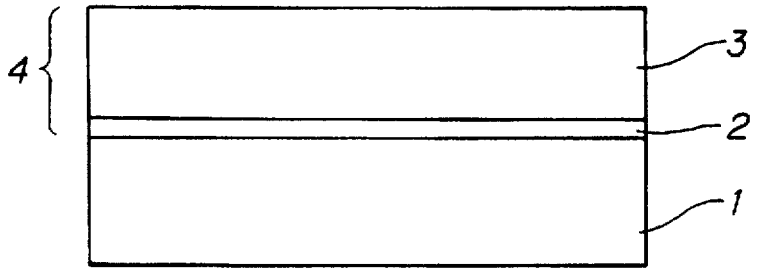
FIG. 1 is a schematic cross-sectional view showing one embodiment of double-layered photoconductive structures (function-separated type electrophotographic photoreceptor) according to the present invention.

In the present invention, in order to enhance durability in the electrical and mechanical characteristics of a photoreceptor which meets a recent trend of an increase in the speed in copying machines, printers and the like, it has been considered to use a mixed system of a plurality of resins such as polycarbonate and polyester and/or polyarylate for a photoreceptor from the viewpoint of an enhancement in abrasion resistance and compatibility with a charge-transporting material, wherein it has been investigated to solve a problem on the deterioration of the electrical characteristics by a mixed resin system capable of being putted to practical use, not by copolymers which are difficult to synthesize. As a result thereof, it has been found that the deterioration of the electrical characteristics originates in the inferior compatibility of the resins themselves used as binder resins. With respect to a method for confirming the compatibility, a resin mixture prepared by mixing resins in a prescribed ratio is measured for a glass transition point, wherein if a plurality of glass transition points originating in the glass transition points of the respective mixed resins is observed, this mixed system is not considered to fall in a compatible state, and if any glass transition point is not observed or only one glass transition point which does not originate in the glass transition point of some resin alone appears, this mixed system is considered to fall in a compatible state.

It is considered that in a system in which mixed resins do not reside in a compatible state, a plurarity of binder resins contained in a photoreceptor exists in an uneven state, and therefore this unevenness is considered to be a factor which deteriorates the electrical characteristics. Further, there has existed as well the defect that because of this unevenness, a solution for a photoconductive layer used in forming the photoconductive layer by an applying method such as bar coating and dip-coating or other methods such as spraying causes separation and gelation while using, and therefore it does not stand use over an extended period of time. In a compatible system, however, binder resins are considered to be uniformized in a photoreceptor, and therefore it can be considered that the electrical characteristics are not deteriorated as is the case with copolymers. Further, the solution for a photoconductive layer can be stably used as well over a long period of time without separating and gelatinizing.

Accordingly, when a mixed system of a plurality of resins such as polycarbonate and polyester and/or polyarylate is used for a photoreceptor, a composition having no or only one glass transition point as judgement for the compatibility has been prepared, whereby an electrophotographic photoreceptor improved in durability has been successfully obtained. Further, the solution for a photoconductive layer having such composition can stably be used over an extended period of time without causing separation and gelation while using it in forming the photoconductive layer by an applying method such as bar coating and dip-coating or other methods such as spraying.

The electrophotographic photoreceptor of the present invention (hereinafter referred to as the photoreceptor) will be explained below with reference to the drawings. First, double-layered photoconductive structures (function-separated type photoreceptor) will be explained. As shown in FIG. 1, the double-layered photoconductive structures are composed of a conductive support 1 and a photoconductive layer 4, and the photoconductive layer 4 comprises a charge-generating layer 2 and a charge-transporting layer 3.

There can be used as the conductive support used for the photoreceptor of the present invention, supports having conductivity, for example, aluminum, aluminum alloy, copper, zinc, stainless, nickel, and titanium. In addition thereto, there can be used as well: plastics and paper on which aluminum, gold, silver, copper, zinc, nickel, titanium, indium oxide, tin oxide, or the like is deposited; plastics and paper containing conductive grains; and plastics containing a conductive polymer etc. They can be used in the forms of drum, sheet seamless belt and the like.

There can be used as a charge-generating material contained in the charge-generating layer, inorganic photoconductive materials such as Se, alloys thereof, arsenic-selenium, cadmium sulfide, zinc oxide and amorphous silicon, organic pigments such as phthalocyanines, azo compounds, quinacridone, polycyclic quinones and perylene, and organic dyes such as thiapyrylium salts and squalilium salts. They may be used in combination of two or more kinds. There may be added to the charge-generating layer, electron-accepting materials as chemical sensitizers, for example, cyano compounds such as tetracyano-ethylene and 7,7,8,8-tetracyanoquinodimethane, quinones such as anthraquinone and p-benzoquinone, nitro compounds such as 2,4,7-trinitrofluorenone and 2,4,5,7-tetranitrofluorenone, or dyes as optical sensitizers, such as xanthene series dyes, thiazine series dyes and triphenylmethane series dyes.

The charge-generating layer can be formed by gas phase deposition such as vacuum deposition, sputtering and CVD, or in the case where a support is a sheet, by a Baker applicator, a bar coater, casting or spin coating, and in the case where the support is a drum, by spraying, a vertical type ring method or dip-coating, wherein a charge-generating material is disolved or it is pulverized and dispersed with a ball mill, a sand grinder, a paint shaker or a supersonic disperser, and then a binder resin and a solvent are added thereto if necessary.

The binder resins used for forming the charge-generating layer include polyarylate, polyvinylbutyral, polycarbonate, polyester resins, polystyrene, polymethyl methacrylate, polyvinyl chloride, phenoxy resins, epoxy resins and silicone resins. They may be used in combination of two or more kinds.

The solvents used for dissolving the binder resins for the charge-generating layer include ketones such as acetone, methyl ethyl ketone and cyclohexanone, esters such as ethyl acetate and butyl acetate, ethers such as tetrahydrofuran and dioxane, aromatic hydrocarbons such as benzene, toluene and xylene, and aprotic polar solvents such as N,N-dimethylformamide and dimethylsulfoxide.

The film thickness of the charge-generating layer is in the range of 0.05 to 5 μm, preferably 0.08 to 1 μm. The film thickness of the charge-generating layer thiner than 0.05 μm deteriorates the sensitivity and can not provide a copy having a suitable density. On the other hand, the film thickness of the charge-generating layer exceeding 5 μm increases the accumulation of the residual potential and provides a black and stained copy.

The charge-transporting material contained in the charge-transporting layer includes high molecular compounds such as polyvinylcarbazole and polysilane, and low molecular compounds such as hydrazone compounds, pyrazoline compounds, oxadiazole compounds, stilbene compounds, triphenylmethane compounds, triphenylamine compounds and enamine compounds. The respective compounds described above may be used in combination of two or more kinds.

The charge-transporting layer is formed by dissolving the charge-transporting material in a solvent, adding the binder resin used in the present invention, and applying the resulting solution by a Baker applicator, a bar coater, casting or spin coating in the case where the support is a sheet, and by spraying, a vertical type ring method or dip-coating using the solution in the case where the support is a drum.

A polymer mixture having no or only one glass transition point as a result of mixing a plurality of polymers is used as the binder resin used for forming the charge-transporting layer. Polymers constituting the binder resin include polycarbonate, polyarylate, polyether ketone, epoxy resins, urethane resins, cellulose ethers, copolymers obtained by polymerizing monomers necessary for preparing the above polymers, polyester resins composed of aromatic dicarboxylic acid components and glycol components, represented by polyethylene terephthalate, acrylic resins comprising main components of non-functional monomers such as methacrylic esters, and copolymers obtained by polymerizing functional monomers having functional groups such as a carboxyl group and a hydroxyl group with the monomers necessary for preparing the polymers described above. In the present invention, for instance, polycarbonates each having different molecular weights are considered to be polymers different from each other, and a mixture of these two polycarbonates constitutes the binder resin used in the present invention.

The polycarbonate used in the present invention can be obtained by known methods in which dihydric phenol and phosgene are polymerized, and the terminals thereof are sealed with monofunctional compounds. To describe concretely, dihydric phenols include 4,4'-(1-methylethylidene)bisphenol, 4,4'-(1-methylethylidene)-bis[2-methylphenol], 4,4'-cyclohexylidene-bisphenol, 4,4'-ethylidene-bisphenol, 4,4'-(1, 3-dimethylbutylidene) bisphenol, 4,4'-(1-methylethylidene)bis-[2,6-dimethylphenol], 4,4'-(1-phenylethylidene)bisphenol, 4,4'-(2-ethylhexylidene)bisphenol, 5,5'-(1-methylethylidene)[1,1'-biphenyl]-2-ol, [1,1'-biphenyl]-4,4'-diol, 4,4'-methylidene-bisphenol, 4,4'-methylene-bis[2-(2-propenyl) phenol], 4,4'-methylidene-bis[2-methylphenol], 4,4'-propanediyl-bisphenol, 4,4'-(1-methyl-propylidene) bisphenol, 4,4'-(2-methyl-propylidene)bisphenol, 4,4'-(3-methylbutylidene)bisphenol, 4,4'-cyclopentylidene-bisphenol, 4,4'-(phenylmethylidene)bisphenol, 4,4'-(1-methyl-heptylidene)bisphenol, 4,4'-cyclohexylidene-bis[3-mehylphenol], 4,4'-(1-methylethylidene)bis[2-(2propenyl) phenol], 4,4'-(1-methylethylidene)bis[2-(1-methylethyl) phenol], 4,4'-(1-methyloctylidene)bisphenol, 4,4'-(1-phenylethylidene)bis[2-methylphenol], 4,4'cyclohexylidene-bis[2,6-dimethylphenol], 4,4'-(1-methyl)nonylidene-bisphenol, 4,4'-decylidene-bisphenol, 4,4'-(1-methylethylidene)bis[2-(1,1-methylpropyl)-phenol], 4,4'-(1-methylethylidene)bis[2-(1,1-dimethyl-ethyl)phenol], 4,4'-(diphenylmethylidene)bisphenol, 4,4'-cyclohexylidene-bis[2(1,1-dimethylethyl)phenol], 4,4'-(2-methylpropylidene)bis[3-methyl-6-(1,1-dimethylethyl) phenol], 4,4'-(1-methylethylidene)-bis[2cyclohexylphenol], 4,4'-methylene-bis[2,6-bis-(1,1-dimethylethyl)phenol], 4,4'-methylene-bis[2,6-di-sec-butylphenol], 5,5'-(1,1-cyclohexylidene)bis-(1,1'-biphenyl)-2ol, 4,4'-cyclohexylidene-bis[2-cyclohexyl-phenol], 2,2'-methylene-bis[4-nonylphenol], 4,4'-(1-methylethylidene)bis[2,6-bis(1,1-dimethylethyl)-phenol], 5,5'-(1-phenolethylidene)[1,1'-bipheyl]-2-ol, bis(4-hydroxyphenyl)methanone, 4,4'-methylene-bis [2-fluorophenol], 4,4'- [2, 2, 2- trifluoro - 1 - (trifluoromethyl)ethylidene]bisphenol, 4,4'-isopropylidene-bis-[2-fluorophenol], 4,4'-[(4-fluorophenyl)-methylene)]bis [2-fluoro-phenol], 4,4'-(phenyl-methylene)bis[2-fluorophenol], 4,4'-[(4-fluorophenyl)-methylene]bisphenol, 4,4'-(1-methylethylidene)bis[2-chloro-6-methylphenol], 4,4'-(1-methylethylidene)bis-[2,6-dichlorophenol], 4,4'-(1-methylethylidene)bis[2-chlorophenol], 4,4'-methylene-bis [2,6-dibromophenol], 4,4'-(1-methylethylidene)bis[2,6-dibromophenol], 4,4'-(1-methyl-ethylidene)bis[2-nitrophenol], 3,3'-dimethyl-[1,1'-biphenyl]-4,4'-diol, 3,3',5,5'-tetramethyl-[1,1'-biphenyl]-4,4'-diol, 3,3',5,5'-tetra-t-butyl-[1,1'-biphenyl]-4,4'-diol, 3,3'-difluoro-[1,1'-biphenyl]-4,4'-diol, and 3,3',5,5'-tetrafluoro-[1,1'biphenyl]-4,4'-diol.

The compounds described above may be used in combination of two or more kinds. Preferred particularly from the viewpoint of the reactivity are 4,4'-(1-methylethylidene) bisphenol, 4,4'-(1-methylethylidene)bis [2-methylphenol], and 4,4'-cyclohexylidene-bisphenol.

The solvents used for dissolving the binder resins for the charge-transporting layer include halogen series solvents such as dichloromethane and 1,2 -dichloroethane, ketones such as acetone, methyl ethyl ketone and cyclohexanone, esters such as ethyl acetate and butyl acetate, ethers such as tetrahydrofuran and dioxane, aromatic hydrocarbons such as benzene, toluene and xylene, and aprotic polar solvents such as N,N-dimethylformamide and dimethylsulfoxide.

The film thickness of the charge-transporting layer is in the range of 5 to 50 μm, preferably 10 to 40 μm. The film thickness of the charge-transporting layer smaller than 5 μm deteriorates the charging property and provides white and blurred copies. Further, it causes the film to disappear due to abrasion. On the other hand, the film thickness of the charge-transporting layer exceeding 50 μm increases the deterioration of the sensitivity and can not provide copies having a suitable density. Further, it increases the accumulation of the residual potential and provides black and stained copies.

Antioxidants may be added to the charge-generating layer or charge-transporting layer as an additive. Used as the antioxidant are vitamin E, hydroquinone, hindered amines, hindered phenols, paraphenylenediamine, arylalkanes, derivatives thereof, organic sulfur compounds, organic phosphorus compounds and the like.

Figure 2:
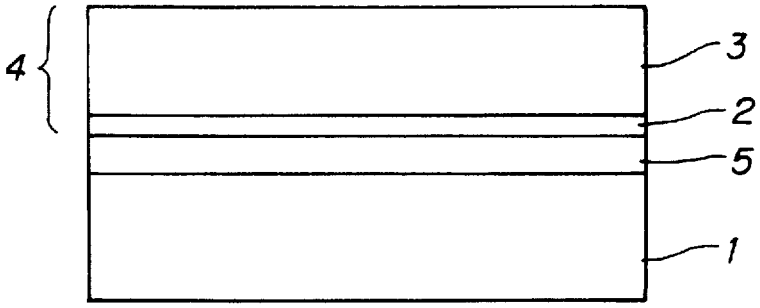
FIG. 2 is a schematic cross-sectional view showing another embodiment of the double-layered photoconductive structures according to the present invention.

As shown in FIG. 2, an under-coating layer 5 may be provided as an intermediate layer between the conductive support 1 and the photoconductive layer 4. This controls the degradation of the sensitivity and prevents the charging property from lowering. Used as the under-coating layer are polyvinyl alcohol, polyvinylbutyral, polyvinylpyrrolidone, polyacrylic acid, celluloses, gelatins, starches, polyurethanes, polyimides, casein, N-methoxymethylated nylon, an aluminum anodic oxide film and the like. Further, grains of titanium oxide, tin oxide, aluminum oxide or the like may be dispersed therein.

In a dip-coating method comprising the steps of: dipping a drum-shaped conductive support having a charge-generating layer containing a charge-generating material on the surface of the support in a solution for a charge-transporting layer containing a charge-transporting material, a binder resin having no or one glass transition point and a solvent; pulling up the conductive support from the solution; and drying the conductive support to remove the solvent from the solution, thereby forming the charge-transporting layer on the charge-generating layer described above, the binder resin is preferably dissolved in the solution for the charge-transporting layer in a proportion falling in a range of 5 weight % to 17 weight % based on the solvent. The binder resin concentration of less than 5 weight % reduces the viscosity of the solution for the charge-transporting layer and makes it difficult to obtain the uniform film thickness. On the other hand, the binder resin concentration exceeding 17 weight % increases the viscosity of the solution for the charge-transporting layer and makes it impossible to obtain the uniform film thickness at a practical applying rate in the production process.

Figure 3:
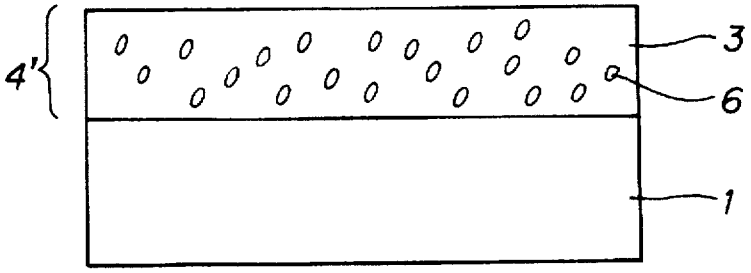
FIG. 3 is a schematic cross-sectional view showing one embodiment of a single layer type electrophotographic photoreceptor according to the present invention.
Figure 4:
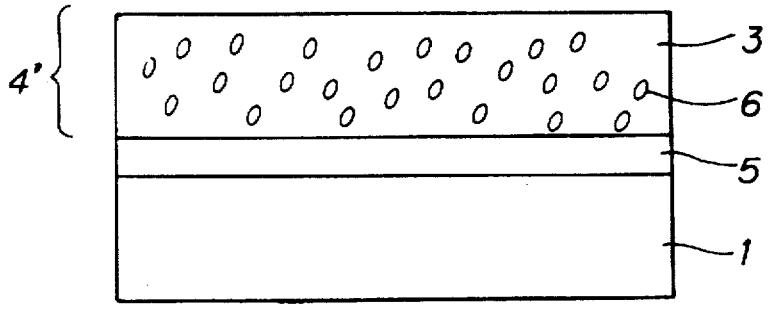
FIG. 4 is a schematic cross-sectional drawing showing another embodiment of the single layer type electrophotographic photoreceptor according to the present invention.

Next, the single layer type photoreceptor will be explained in detail. As shown in FIG. 3, the single layer type photoreceptor comprises a conductive support 1 and a photoconductive layer 4', and this photoconductive layer 4' is formed by dispersing finely a charge-generating material 6 in a charge-transporting layer 3. The charge-transporting material contained in the charge-transporting layer of the single layer type photoreceptor, a process for forming the charge-transporting layer, a binder resin used for forming the charge-transporting layer, a solvent used for dissolving the binder resin, the film thickness of the charge-transporting layer, and additives are the same as those employed in forming the charge-transporting layer of the double-layered photoconductive structures described above. Further, as shown in FIG. 4, an under-coating layer 5 may be provided between the support 1 and the photoconductive layer 4' also in the single layer type photoreceptor. This under-coating layer is also the same as that explained in the double-layered photoconductive structures described above.

Further, in a dip-coating method comprising the steps of: dipping a drum-shaped conductive support in the solution for the photoconductive layer containing the charge-generating material, the binder resin having no or one glass transition point and the solvent; pulling up the conductive support from the solution; and drying the conductive support to remove the solvent from the solution, thereby forming the photoconductive layer, the binder resin is preferably dissolved in the solution for the photoconductive layer in a proportion falling in a range of 5 weight % to 17 weight % based on the solvent. The reason therefor is also the same as that explained in the double-layered photoconductive structures described above.

EXAMPLES

The present invention will be concretely explained below with reference to examples and comparative examples but the present invention will not be restricted to the following examples.

An abrasion tester (manufactured by Suga Tester Co., Ltd.) was used for evaluating an abrasion property. It was determined under applying a load of 200 g·f at an abrasion frequency of 10,000 cycles with an abrasive of aluminum oxide #2000.

Example 1 (double-layered photoconductive structures)

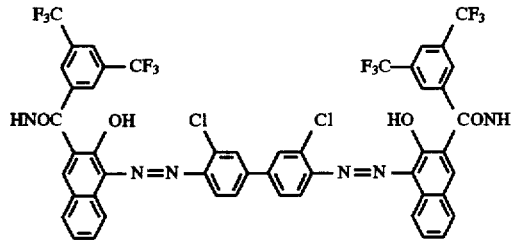

(I)

A bisazo series pigment of 2 parts by weight which is a charge-generating material represented by the structural formula (I) shown above, a phenoxy resin (PKHH: manufactured by Union Carbide Co., Ltd.) of 1 part by weight and 1,4-dioxane of 97 parts by weight were dispersed with a ball mill disperser for 12 hours to prepare a dispersion solution. This was put in a tank, and an aluminum-made cylindrical support (aluminum drum) having a diameter of 80 mm and a length of 348 mm was dipped therein. Then, the support was pulled up and dried at room temperatures for one hour, whereby a charge-generating layer having a thickness of 1 μm was formed.

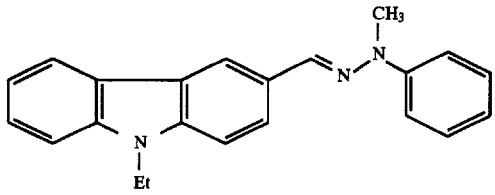

(II)

On the other hand, a hydrazone series compound of 100 parts by weight represented by the above structural formula (II) as a charge-transporting material, and polycarbonate of 40 parts by weight having a viscosity-average molecular weight of 38,000 (C-1400: manufactured by Teijin Chemicals Co., Ltd.), polyarylate of 40 parts by weight having a viscosity-average molecular weight of 43,000 (U-100: manufactured by Unitika Co., Ltd.) and a polyester resin of 20 parts by weight having a viscosity-average molecular weight of 21,000 (V-200: manufactured by Toyobo Co., Ltd.) as the binder resin were dissolved in dichloromethane of 800 parts by weight to prepare a solution for a charge-transporting layer. The resulting solution was applied on the previously formed charge-generating layer by dipping and dried at 80° C. for one hour to form a charge-transporting layer having a thickness of 20 μm, whereby a sample as shown in FIG. 1 was prepared. The sample thus obtained had a uniform film.

This sample was loaded in a commercially available copying machine (SF8870: manufactured by Sharp Co., Ltd.) and subjected to a copying test using A4 size paper, wherein the image characteristics, the charge potential (Vo) and the residual potential (Vr) were measured at the beginning and after used in 40,000 cycles.

The dispersion solution for the charge-generating layer prepared above was used to apply it on polyethylene terephthalate, on which aluminum is deposited, having a thickness of 100 μm with a Baker applicator and dried at room temperatures for one hour to form a charge-transporting layer having a thickness of 0.2 μm. Further, the solution for the charge-transporting layer prepared above was applied on the charge-generating layer formed above with the Baker applicator and dried at 80° C. for one hour to form a charge-transporting layer having a thickness of 20 μm, whereby a photoreceptor as shown in FIG. 1 was prepared. The photoreceptor had a uniform film on the surface.

This photoreceptor was evaluated for an abrasion characteristic.

Further, a sample having the same mixing ratio as that of the binder resin components constituting the charge-transporting layer was prepared and measured for a glass transition point with a differential scanning calorimetric (DSC) equipment.

The results thereof are shown in Table 1. Fine images were obtained both at the beginning and after repeated use, and a reduction in the sensitivity due to a decrease in the film thickness caused by abrasion was scarcely observed. Further, only one glass transition point was observed.

Example 2

Various samples used for evaluating the images and the abrasion characteristic and measuring DSC were prepared and evaluated in the same manners as those employed in Example 1, except that polycarbonate of 60 parts by weight having a viscosity-average molecular weight of 39,000 (Z-400: manufactured by Mitsubishi Gas Chemical Co., Ltd.) and a polyester resin of 40 parts by weight having a viscosity-average molecular weight of 29,000 (V-103: manufactured by Toyobo Co., Ltd.) were used as the binder resin. The results thereof are shown in Table 1. Fine images were obtained both at the beginning and after repeated use, and a reduction in the sensitivity due to a decrease in the film thickness caused by abrasion was scarcely observed. Further, only one glass transition point was observed.

Example 3

Various samples used for evaluating the images and the abrasion characteristic and measuring DSC were prepared and evaluated in the same manners as those employed in Example 1, except that polycarbonate of 95 parts by weight having a viscosity-average molecular weight of 30,000 (K-1300: manufactured by Teijin Chemicals Co., Ltd.) and an acrylic resin of 5 parts by weight having a viscosity-average molecular weight of 65,000 (Dianal BR-64: manufactured by Mitsubishi Rayon Co., Ltd.) were used as the binder resin. The results thereof are shown in Table 1. Fine images were obtained both at the beginning and after repeated use, and a reduction in the sensitivity due to a decrease in the film thickness caused by abrasion was scarcely observed. Further, only one glass transition point was observed.

Example 4

Various samples used for evaluating the images and the abrasion characteristic and measuring DSC were prepared and evaluated in the same manners as those employed in Example 1, except that polycarbonate of 90 parts by weight having a viscosity-average molecular weight of 45,000 obtained by copolymerizing 4,4'-(1methylethylidene) bisphenol with 4,4'-(1-cyclohexylidene)bisphenol and a polyester resin of 10 parts by weight having a viscosity-average molecular weight of 22,000 (V-290: manufactured by Toyobo Co., Ltd.) were used as the binder resin. The results thereof are shown in Table 1. Fine images were obtained both at the beginning and after repeated use, and a reduction in the sensitivity due to a decrease in the film thickness caused by abrasion was scarcely observed. Further, only one glass transition point was observed.

Example 5

Various samples used for evaluating the images and the abrasion characteristic and measuring DSC were prepared and evaluated in the same manners as those employed in Example 1, except that polycarbonate of 80 parts by weight having a viscosity-average molecular weight of 28,500 (301-4: manufactured by Sumitomo Dow Corning Co., Ltd.) and polyarylate of 20 parts by weight having a viscosity-average molecular weight of 40,000 prepared from 4,4'-(1-methylethylidene)bis[2-methylphenol]were used as the binder resin. The results thereof are shown in Table 1. Fine images were obtained both at the beginning and after repeated use, and a reduction in the sensitivity due to a decrease in the film thickness caused by abrasion was scarcely observed. Further, only one glass transition point was observed.

Example 6

Various samples used for evaluating the images and the abrasion characteristic and measuring DSC were prepared and evaluated in the same manners as those employed in Example 1, except that polycarbonate of 90 parts by weight having a viscosity-average molecular weight of 28,500

(301-4: manufactured by Sumitomo Dow Corning Co., Ltd.) and a polyester resin of 10 parts by weight having a viscosity-average molecular weight of 22,000 (V-290: manufactured by Toyobo Co., Ltd.) were used as the binder resin. The results thereof are shown in Table 1. Fine images were obtained both at the beginning and after repeated use, and a reduction in the sensitivity due to a decrease in the film thickness caused by abrasion was scarcely observed. Further, only one glass transition point was observed.

Example 7

Various samples used for evaluating the images and the abrasion characteristic and measuring DSC were prepared and evaluated in the same manners as those employed in Example 1, except that polycarbonate of 80 parts by weight having a viscosity-average molecular weight of 38,000 (C-1400: manufactured by Teijin Chemicals Co., Ltd.) and polycarbonate of 20 parts by weight having a viscosity-average molecular weight of 21,500 (Z-200: manufactured by Mitsubishi Gas Chemical Co., Ltd.) were used as the binder resin. The results thereof are shown in Table 1. Fine images were obtained both at the beginning and after repeated use, and a reduction in the sensitivity due to a decrease in the film thickness caused by abrasion was scarcely observed. Further, only one glass transition point was observed.

Example 8

Various samples used for evaluating the images and the abrasion characteristic and measuring DSC were prepared and evaluated in the same manners as those employed in Example 1, except that polycarbonate of 70 parts by weight having a viscosity-average molecular weight of 38,000 (C-1400: manufactured by Teijin Chemicals Co., Ltd.), polycarbonate of 20 parts by weight having a viscosity-average molecular weight of 79,000 (Z-800: manufactured by Mitsubishi Gas Chemical Co., Ltd.) and a polyester resin of 10 parts by weight having a viscosity-average molecular weight of 22,000(V-290: manufactured by Toyobo Co., Ltd.) were used as the binder resin. The results thereof are shown in Table 1. Fine images were obtained both at the beginning and after repeated use, and a reduction in the sensitivity due to a decrease in the film thickness caused by abrasion was scarcely observed. Further, only one glass transition point was observed.

Comparative Example 1

Various samples used for evaluating the images and the abrasion characteristic and measuring DSC were prepared and evaluated in the same manners as those employed in Example 1, except that polycarbonate of 40 parts by weight having a viscosity-average molecular weight of 98,000 synthesized from 4,4'-(1-methylethylidene)bis[2-methylphenol], polyarylate of 40 parts by weight having a viscosity-average molecular weight of 43,000 (U-100: manufactured by Unitika Co., Ltd.) and a polyester resin of 20 parts by weight having a viscosity-average molecular weight of 21,000 (V200: manufactured by Toyobo Co., Ltd.) were used as the binder resin. The results thereof are shown in Table 1. While the abrasion characteristic was good, the uniform solution was not obtained when preparing the solution for the charge-transporting layer. Spots were generated on the photoreceptor from the beginning, and black spots were observed on the images. Further, the glass transition points. were observed in two points, which led to estimating that no compatibility was attained.

Comparative Example 2

Various samples used for evaluating the images and the abrasion characteristic and measuring DSC were prepared and evaluated in the same manners as those employed in Example 1, except that polycarbonate of 80 parts by weight having a viscosity-average molecular weight of 98,000 synthesized from 4,4'-(1-methylethylidene)bis[2-methylphenol]and a polyester resin of 20 parts by weight having a viscosity-average molecular weight of 21,000 (V-200: manufactured by Toyobo Co., Ltd.) were used as the binder resin. The results thereof are shown in Table 1. The abrasion characteristic was good, and the fine images were obtained at the beginning. However, the repeated use increased markedly the residual potentials and thickened very much the density of the images as compared with that observed at the beginning, which caused fogging on the background. Further, the glass transition points were observed in two points, which led to estimating that no compatibility was attained.

Comparative Example 3

Various samples used for evaluating the images and the abrasion characteristic and measuring DSC were prepared and evaluated in the same manners as those employed in Example 1, except that polycarbonate of 90 parts by weight having a viscosity-average molecular weight of 98,000 synthesized from 4,4'-(1-methylethylidene)bis[2-methylphenol]and polyarylate of 10 parts by weight having a viscosity-average molecular weight of 43,000 (U-100: manufactured by Unitika Co., Ltd.) were used as the binder resin. The results thereof are shown in Table 1. The abrasion characteristic was good, and the fine images were obtained at the beginning. However, the repeated use increased markedly the residual potentials and thickened very much the density of the images as compared with that observed at the beginning, which caused fogging on the background. Further, the glass transition points were observed in two points, which led to estimating that no compatibility was attained.

Comparative Example 4

Various samples used for evaluating the images and the abrasion characteristics and measuring DSC were prepared and evaluated in the same manners as those in Example 1, except that polycarbonate of 70 parts by weight having a viscosity-average molecular weight of 38,000 (C-1400: manufactured by Teijin Chemicals Co., Ltd.) and polycarbonate of 30 parts by weight having a viscosity-average molecular weight of 98,000 synthesized from 4,4'-(1-methylethylidene)bis[2-methylphenol]were used as the binder resin. The results thereof are shown in Table 1. The abrasion characteristic was good, and the fine images were obtained at the beginning. However, the repeated use increased markedly the residual potentials and thickened very much the density of the images as compared with that observed at the beginning, which caused fogging on the background. Further, the glass transition points were observed in two points, which led to estimating that no compatibility was attained.

Comparative Example 5

In order to prepare a copolymer of polycarbonate with a polyester resin as the binder resin, used were 4,4'-(1-methylethylidene)bis[2-methylphenol]as a polycarbonate component as well as isophthalic acid, terephthalic acid, ethylene glycol and bisphenol A-ethylene oxide adduct as polyester resin components to try the copolymerization thereof by various production processes, but any copolymer could not be produced.

Comparative Example 6

In order to prepare a copolymer of polycarbonate with a polyester resin as the binder resin, used were 4,4'-(1-methylethylidene)bispheniol as a polycarbonate component as well as isophthalic acid, terephthalic acid, ethylene glycol, and bisphenol A-ethylene oxide adduct as polyester resin components to try the copolymerization thereof by various production processes, but any copolymer could not be produced.

Example 9 (Double-Layered Photoconductive Structures provided with an Under-Coating Layer)

Copolymerized nylon (CM8000: manufactured by Toray Co., Ltd.) of 6 parts by weight was dissolved in a mixed solvent of methyl alcohol of 47 parts by weight and chloroform of 47 parts by weight, and the resulting solution was put in a tank. An aluminum-made cylindrical support having a diameter of 30 mm and a length of 255 mm was dipped in the solution and pulled up to coat it with the solution, followed by drying it at 110° C. for 10 minutes, whereby an under-coating layer having a thickness of about 2 μm was provided.

(III)

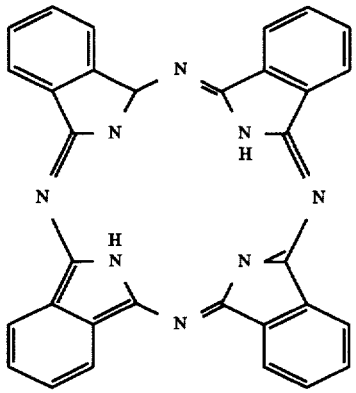

Next, X type non-metal phthalocyanine of 2 parts by weight which is a charge-generating material represented by the structural formula (III) shown above, a polyvinylbutyral resin (Eslex BMS: manufactured by Sekisui Chemical Co., Ltd.) of 10 parts by weight and dichloroethane of 97 parts by weight were dispersed with a ball mill disperser for 12 hours to prepare a dispersion solution, which was put in a tank. The preceding aluminum-made cylindrical support provided with the under-coating layer was dipped therein and pulled up to coat it with the solution, followed by drying at room temperatures for one hour, whereby a charge-generating layer having a thickness of 0.2 μm was formed.

(IV)

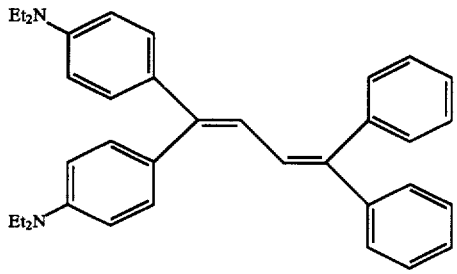

On the other hand, a styryl series compound of 100 parts by weight represented by the structural formula (IV) shown above as a charge-transporting material, polycarbonate of 80 parts by weight having a viscosity-average molecular weight of 30,000 (K-1300: manufactured by Teijin Chemicals Co., Ltd.) and a polyester resin of 20 parts by weight having a viscosity-average molecular weight of 29,000 (V-103: manufactured by Toyobo Co., Ltd.) as the binder resin were dissolved in chloroform of 800 parts by weight to prepare a solution for a charge-transporting layer. The resulting solution was applied on the charge-generating layer formed above by dipping and dried at 100° C. for one hour, whereby the charge-transporting layer having a thickness of 20 μm was formed. The sample thus prepared had a uniform film. This sample was loaded into a commercially available laser beam printer (JX9500: manufactured by Sharp Co., Ltd.), and various samples used for evaluating the images and the abrasion characteristic and measuring DSC were evaluated in the same manners as those employed in Example 1. The results thereof are shown in Table 1. Fine images were obtained both at the beginning and after repeated use, and a reduction in the sensitivity due to a decrease in the film thickness caused by abrasion was scarcely observed. Further, only one glass transition point was observed.

Example 10 (Single Layer type Photoreceptor)

(V)

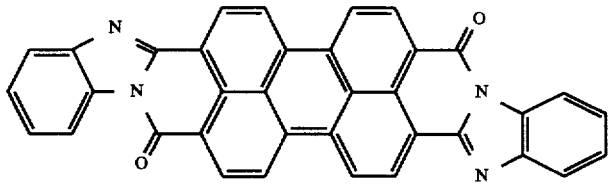

A perylene pigment of 2 parts by weight which is a charge-generating material represented by the structural formula (V) shown above and 1,2-dichloroethane of 98 parts by weight were dispersed with a paint shaker to prepare a dispersion solution. Added thereto were a solution prepared by dissolving a hydrazone series compound of 100 parts by weight

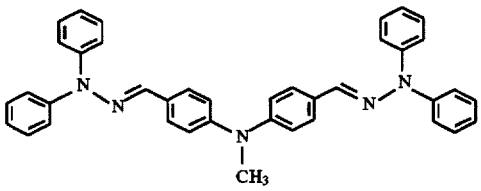

(VI)

represented by the structural formula (VI) shown above as a charge-transporting material, polycarbonate of 80 parts by weight having a viscosity-average molecular weight of 39,000 (z-400: manufactured by Mitsubishi Gas Chemical Co., Ltd.) and a polyester resin of 20 parts by weight having a viscosity-average molecular weight of 22,000 (V-290: manufactured by Toyobo Co., Ltd.) as the binder resin in dichloromethane of 700 parts by weight, thereby preparing a solution for a photoconductive layer. The resulting solution was applied on an aluminum-made cylindrical support by dipping and dried at 100° C. for one hour to form the photoconductive layer having a thickness of 15 μm, whereby a photoreceptor as shown in FIG. 3 was prepared. The sample thus prepared had a uniform film. This sample was loaded into an experimental machine obtained by remodeling a commercially available copying machine (SF8100: manufactured by Sharp Co., Ltd.) to a positively charging model, and various samples used for evaluating the images and the abrasion characteristics and measuring DSC were evaluated in the same manners as those employed in Example 1. The results thereof are shown in Table 1. Fine images were obtained both at the beginning and after repeated use, and a reduction in the sensitivity due to a decrease in the film thickness caused by abrasion was scarcely observed. Further, only one glass transition point was observed.

Example 11 (Double-Layered Photoconductive Structures provided with an alumite Layer)

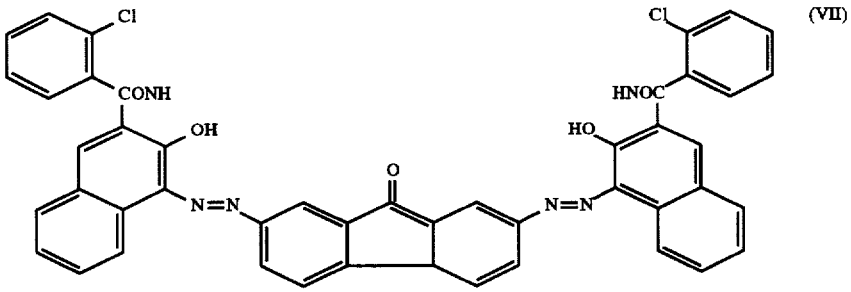

(VII)

A bisazo pigment of 2 parts by weight which is a charge-generating material represented by the structural formula (VII) shown above, a polyvinylbutyral resin (XYHL: manufactured by Union Carbide Co., Ltd.) of 1 part by weight and cyclohexanone of 97 parts by weight were dispersed with a ball mill to prepare a dispersion solution, which was put in a tank. The surface of an aluminum-made cylindrical support having a diameter of 80 mm and a length of 348 mm was provided with an alumite layer having a thickness of 5 μm by anodic oxidation, and the resulting support was dipped in the dispersion solution to coat it with the solution, followed by drying at 110° C. for 10 minutes, whereby a charge-generating layer having a thickness of 0.8 μm was formed.

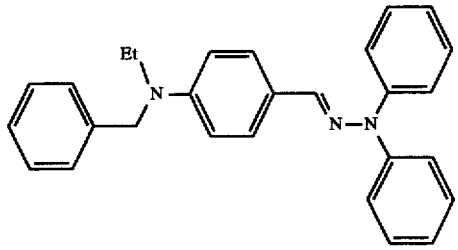

(VIII)

On the other hand, a hydrazone series compound of 100 parts by weight represented by the above structural formula (VIII) as a charge-transporting material, polycarbonate of 70 parts by weight having a viscosity-average molecular weight of 39,000 (Z-400: manufactured by Mitsubishi Gas Chemical Co., Ltd.) and an acrylic resin of 30 parts by weight having a viscosity-average molecular weight of 70,000 (Dianal BR-79: manufactured by Mitsubishi Rayon Co., Ltd.) as the binder resin were dissolved in dichloromethane of 800 parts by weight to prepare a solution for a charge-transporting layer. The resulting solution was applied on the charge-generating layer formed previously by dipping and was dried at 80° C. for one hour to form the charge-transporting layer having a thickness of 25 μm. The sample thus prepared had a uniform film. Various samples used for evaluating the images and the abrasion characteristic and measuring DSC were evaluated in the same manners as those employed in Example 1. The results thereof are shown in Table 1. Fine images were obtained both at the beginning and after repeated use, and a reduction in the sensitivity due to a decrease in the film thickness caused by abrasion was scarcely observed. Further, only one glass transition point was observed.

Example 12 (Sheet Type Photoreceptor)

A perylene pigment of 2 parts by weight which is a charge-generating material represented by the structural formula (V) in Example 10, a phenoxy resin (PKHH: manufactured by Union Carbide Co., Ltd.) of 1 part by weight and 1,4-dioxane of 97 parts by weight were dispersed with a ball mill disperser for 12 hours to prepare a dispersion solution. This was applied on a conductive support, having an aluminum layer formed on the surface of polyethylene terephthalate by deposition, with an applicator and was dried at room temperatures, whereby a charge-generating layer having a thickness of 1 μm was formed.

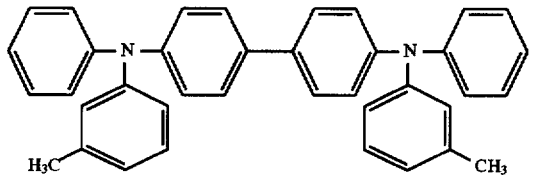

(IX)

On the other hand, a triphenylamine series compound of 100 parts by weight represented by the structural formula (IX) shown above as a charge-transporting material, polycarbonate of 80 parts by weight having a viscosity-average molecular weight of 43,000 synthesized from 4,4-(1-phenylethylidene)bisphenol and a polyester resin of 20 parts by weight having a viscosity-average molecular weight of 22,000 (V-290: manufactured by Toyobo Co., Ltd.) as the binder resin, and dimethylsilicone oil (SH200 50 cs: manufactured by Toray Silicone Co., Ltd.) of 0.02 part by weight were dissolved in dichloromethane of 800 parts by weight to prepare a solution for a charge-transporting layer. The resulting solution was applied on the charge-generating layer formed above with an applicator and was dried at 80° C. for one hour, whereby the charge-transporting layer having a thickness of 25 μm was formed. The sample thus prepared had a uniform film. This sample was adhered on an aluminum-made cylindrical support having a diameter of 80 mm and a length of 348 mm with a conductive tape. The resultant sample was loaded into a commercially available copying machine (SF8870: manufactured by Sharp Co., Ltd.), and various samples used for evaluating the images and the abrasion characteristic and measuring DSC were evaluated in the same manners as those employed in Example 1. The results thereof are shown in Table 1. Fine images were obtained both at the beginning and after repeated use, and a reduction in the sensitivity due to a decrease in the film thickness caused by abrasion was scarcely observed. Further, only one glass transition point was observed.

Example 13 (Double-Layered Photoconductive Structures)

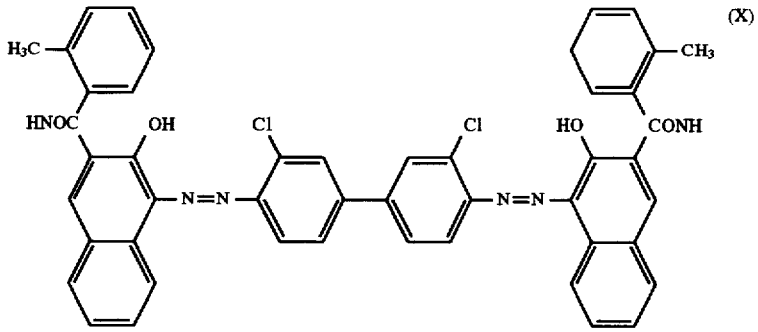

(X)

A bisazo pigment of 2 parts by weight which is a charge-generating material represented by the structural formula (X) shown above, an epoxy resin (Rika Resin BPO-20E: manufactured by Shin Nippon Rika Co., Ltd.) of 1 part by weight and dimethoxyethane of 97 parts by weight were dispersed with a paint shaker for 6 hours to prepare a dispersion solution, which was put in a tank. An aluminum-made cylindrical support (aluminum drum) having a diameter of 80 mm and a length of 348 mm was dipped therein. Then, the support was pulled up and dried at room temperatures for one hour, whereby a charge-generating layer having a thickness of 0.2 μm was formed.

On the other hand, a bishydrazone compound of 100 parts by weight represented by the structural formula (VI) in Example 10 as a charge-transporting material, polycarbonate of 90 parts by weight having a viscosity-average molecular weight of 38,000 (C-1400: manufactured by Teijin Chemicals Co., Ltd.) and a polyester resin of 10 parts by weight having a viscosity-average molecular weight of 22,000 (V-290: manufactured by Toyobo Co., Ltd.) as the binder resin were dissolved in dichloromethane of 800 parts by weight to prepare a solution for a charge-transporting layer. The resulting solution was applied on the charge-generating layer formed above by dipping and was dried at 80° C. for one hour to form the charge-transporting layer having a thickness of 25 μm, whereby a sample as shown in FIG. 1 was prepared. The sample thus prepared had a uniform film. Various samples used for evaluating the images and the abrasion characteristic and measuring DSC were evaluated in the same manners as those employed in Example 1. The results thereof are shown in Table 1. Fine images were obtained either at the beginning or after repeated use, and a reduction in the sensitivity due to a decrease in the film thickness caused by abrasion was scarcely observed. Further, only one glass transition point was observed.

Example 14

Various samples used for evaluating the images and the abrasion characteristic and measuring DSC were prepared and evaluated in the same manners as those employed in Example 1, except that the amount of dichloromethane used for preparing the solution for the charge-transporting layer was reduced to 600 parts by weight. The solution had a high viscosity but the uniform film could be obtained by decreasing the pulling-up rate. The results thereof are shown in Table 1. Fine images were obtained both at the beginning and after repeated use, and a reduction in the sensitivity due to a decrease in the film thickness caused by abrasion was scarcely observed. Further, only one glass transition point was observed.

Example 15

Various samples used for evaluating the images and the abrasion characteristic and measuring DSC were prepared and evaluated in the same manners as those employed in Example 1, except that the amount of dichloromethane used for preparing the solution for the charge-transporting layer was increased to 2000 parts by weight. The solution had a low viscosity but the uniform film could be obtained by increasing the pulling-up rate. The results thereof are shown in Table 1. Fine images were obtained both at the beginning and after repeated use, and a reduction in the sensitivity due to a decrease in the film thickness caused by abrasion was scarcely observed. Further, only one glass transition point was observed.

Comparative Example 7

Various samples used for evaluating the images and the abrasion characteristic and measuring DSC were prepared and evaluated in the same manners as those employed in Example 1, except that the amount of dichloromethane used for preparing the solution for the charge-transporting layer was reduced to 500 parts by weight. The solution had a markedly high viscosity, and the uniform film could not be obtained even by decreasing the pulling-up rate. The results thereof are shown in Table 1. Nonuniformity in the density was caused all over the images.

Comparative Example 8

Various samples used for evaluating the images and the abrasion characteristic and measuring DSC were prepared and evaluated in the same manners as those employed in Example 1, except that the amount of dichloromethane used for preparing the solution for the charge-transporting layer was increased to 2100 parts by weight. The solution for applying had a very low viscosity, and the uniform film could not be obtained even by increasing the pulling-up rate. The results thereof are shown in Table 1.

Example 16

The solution for the charge-transporting layer having the composition obtained in Example 1 as the charge-transporting material was prepared and left for standing to evaluate the stability of the solution based on the viscosity thereof. The viscosity was 80 cP at the beginning and changed to as small extent as 90 cP even after one month. The solution itself was stable as well.

Example 17

The solution for the charge-transporting layer having the composition obtained in Example 2 as the charge-transporting material was prepared and left for standing to evaluate the stability of the solution based on the viscosity thereof. The viscosity was 70 cP at the beginning and changed to as small extent as 80 cP even after one month. The solution itself was stable as well.

Comparative Example 9

The solution for the charge-transporting layer having the composition obtained in Comparative Example 1 as the charge-transporting material was prepared and left for standing to evaluate the stability of the solution based on the viscosity thereof. The viscosity was 170 cP at the beginning and changed to as large extent as 250 cP after one week. The solution itself could not be used.

Comparative Example 10

The solution for the charge-transporting layer having the composition obtained in Comparative Example 2 as the charge-transporting material was prepared and left for standing to evaluate the stability of the solution based on the viscosity thereof. The viscosity was 190 cP at the beginning and changed to as large extent as 290 cP after 3 days. The solution itself could not be used.

TABLE 1

| | | | Charge potential (Vo) | | Residual potential (Vr) | | |
|---|---|---|---|---|---|---|---|
| | Glass transition point (°C.) | Abraded amount (mg) | Beginning (V) | After 40,000 cycles (V) | Beginning (V) | After 40,000 cycles (V) | Evaluation on images |
| 1 (Inv.) | 115 | 4.04 | −740 | −720 | −10 | −20 | Good both at beginning and after 40,000 cycles |
| 2 (Inv.) | 113 | 3.62 | −720 | −710 | −25 | −50 | Good both at beginning and after 40,000 cycles |
| 3 (Inv.) | 115 | 3.92 | −730 | −725 | −30 | −45 | Good both at beginning and after 40,000 cycles |
| 4 (Inv.) | 118 | 3.30 | −725 | −720 | −35 | −40 | Good both at beginning and after 40,000 cycles |
| 5 (Inv.) | 170 | 2.88 | −705 | −690 | −10 | −15 | Good both at beginning and after 40,000 cycles |
| 6 (Inv.) | 123 | 2.61 | −720 | −710 | −20 | −35 | Good both at beginning and after 40,000 cycles |
| 7 (Inv.) | 155 | 2.60 | −700 | −680 | −20 | −45 | Good both at beginning and after 40,000 cycles |
| 8 (Inv.) | 116 | 2.91 | −705 | −690 | −15 | −30 | Godd both at beginning and after 40,000 cycles |
| 9 (Inv.) | 116 | 2.78 | −715 | −700 | −10 | −30 | Good both at beginning and after 40,000 cycles |
| 10 (Inv.) | 110 | 3.58 | 700 | 670 | 40 | 50 | Good both at beginning and after 40,000 cycles |
| 11 (Inv.) | 115 | 3.80 | −710 | −700 | −15 | −35 | Good both at beginning and after 40,000 cycles |
| 12 (Inv.) | 112 | 3.40 | −720 | −705 | −20 | −30 | Good both at beginning and after 40,000 cycles |
| 13 (Inv.) | 118 | 2.78 | −735 | −730 | −10 | −20 | Good both at beginning and after 40,000 cycles |
| 14 (Inv.) | 115 | 4.04 | −710 | −695 | −15 | −30 | Good both at beginning and after 40,000 cycles |
| 15 (Inv.) | 115 | 4.04 | −705 | −695 | −10 | −20 | Good both at beginning and after 40,000 cycles |

TABLE 1-continued

| | Glass transition point (°C.) | Abraded amount (mg) | Charge potential (Vo) Beginning (V) | Charge potential (Vo) After 40,000 cycles (V) | Residual potential (Vr) Beginning (V) | Residual potential (Vr) After 40,000 cycles (V) | Evaluation on images |
|---|---|---|---|---|---|---|---|
| 1 (Comp.) | 123 & 153 | 3.04 | −730 | −710 | −25 | −120 | Black spots generated from beginning |
| 2 (Comp.) | 70 & 120 | 1.36 | −710 | −700 | −15 | −135 | Density increased and fogging generated |
| 3 (Comp.) | 125 & 195 | 1.88 | −705 | −680 | −10 | −200 | Density increased and fogging generated |
| 4 (Comp.) | 120 & 150 | 2.50 | −700 | −680 | −15 | −180 | Density increased and fogging generated |
| 5 (Comp.) | — | — | — | — | — | — | Impossible to evaluate |
| 6 (Comp.) | — | — | — | — | — | — | Impossible to evaluate |
| 7 (Comp.) | 115 | 4.04 | −730 | Impossible to measure | −25 | Impossible to measure | Large unevenness in density & difficult to determine V |
| 8 (Comp.) | 115 | 4.04 | −490 | Impossible to measure | −15 | Impossible to measure | Very faint images due to lack in charge |

What is claimed is:

1. An electrophotographic photoreceptor, comprising:

a conductive support;

a photoconductive layer provided on said conductive support and containing a charge-generating material, a charge-transporting material and a binder resin having no or one glass transition point; said binder being selected from the group consisting of polyarylate, polyether ketone, epoxy resins, urethane resins, cellulose ethers, copolymers obtained by polymerizing monomers necessary for preparing the above polymers, polyester resins, acrylic resins and copolymers obtained by polymerizing functional monomers having functional groups with the monomers necessary for preparing the above polymers.

2. The electrophotographic photoreceptor according to claim 1, wherein said charge-generating material comprises: an inorganic photoconductive material selected from the group consisting of selenium, selenium alloys, arsenic-selenium, cadmium sulfide, zinc oxide, amorphous silicon and mixtures thereof; an organic pigment selected from the group consisting of phthalocyanines, azo compounds, quinacridone, polycyclic quinones, perylene and mixtures thereof; or an organic dye selected from the group consisting of thiapyrylium salts, squalilium salts and mixtures thereof.

3. An electrophotographic photoreceptor according to claim 1, wherein said charge-transporting material comprises: a high molecular compound selected from the group consisting of polyvinylcarbazole, polysilane and mixtures thereof; or a low molecular compound selected from the group consisting of hydrazone compounds, pyrazoline compounds, oxadiazole compounds, stilbene compounds, triphenylmethane compounds, triphenylamine compounds, enamine compounds and mixtures thereof.

4. An electrophotographic photoreceptor according to claim 1, wherein said binder resin comprises at least two polymers selected from the group consisting of polycarbonate, polyarylate, polyether ketone, epoxy resins, urethane resins, cellulose ethers, copolymers obtained by polymerizing monomers necessary for preparing the above polymers, polyester resins, acrylic resins and copolymers obtained by polymerizing functional monomers having functional groups with the monomers necessary for preparing the above polymers.

5. An electrophotographic photoreceptor according to claim 1, wherein an under-coating layer is provided between said conductive support and said photoconductive layer, and said under-coating layer comprises a material selected from the group consisting of an aluminum anodic oxide film, polyvinyl alcohol, polyvinylbutyral, polyvinylpyrrolidone, polyacrylic acid, celluloses, gelatins, starches, polyurethanes, polyimides, casein, N-methoxymethylated nylon and mixtures thereof.

6. An electrophotographic photoreceptor according to claim 1, wherein said photoconductive layer has 5 to 50 μm thick.

7. An electrophotographic photoreceptor, comprising:

a conductive support;

a charge-generating layer provided on said conductive support and containing a charge-generating material; and a charge-transporting layer provided on said charge-generating layer and containing a charge-transporting material and a binder resin having no or one glass transition point; said binder being selected from the group consisting of polyarylate, polyether ketone, epoxy resins, urethane resins, cellulose ethers, copolymers obtained by polymerizing monomers necessary for preparing the above polymers, polyester resins, acrylic resins and copolymers obtained by polymerizing functional monomers having functional groups with the monomers necessary for preparing the above polymers.

8. The electrophotographic photoreceptor according to claim 7, wherein said charge-generating material comprises: an inorganic photoconductive material selected from the group consisting of selenium, selenium alloys, arsenic-selenium, cadmium sulfide, zinc oxide, amorphous silicon and mixtures thereof; an organic pigment selected from the group consisting of phthalocyanines, azo compounds, quinacridone, polycyclic quinones, perylene and mixtures thereof; or an organic dye selected from the group consisting of thiapyrylium salts, squalilium salts and mixtures thereof.

9. An electrophotographic photoreceptor according to claim 7, wherein said charge-generating layer contains a binder resin selected from the group consisting of polyarylate, polyvinylbutyral, polycarbonate, polyester resins, polystyrene, polymethyl methacrylate, polyvinyl chloride, phenoxy resins, epoxy resins, silicone resins and mixtures thereof.

10. An electrophotographic photoreceptor according to claim 7, wherein said charge-transporting material comprises: a high molecular compound selected from the group consisting of polyvinylcarbazole, polysilane and mixtures thereof; or a low molecular compound selected from the group consisting of hydrazone compounds, pyrazoline compounds, oxadiazole compounds, stilbene compounds, triphenylmethane compounds, triphenylamine compounds, enamine compounds and mixtures thereof.

11. An electrophotographic photoreceptor according to claim 7, wherein the binder resin contained in said charge-transporting layer comprises at least two polymers selected from the group consisting of polycarbonate, polyarylate, polyether ketone, epoxy resins, urethane resins, cellulose ethers, copolymers obtained by polymerizing monomers necessary for preparing the above polymers, polyester resins, acrylic resins and copolymers obtained by polymerizing functional monomers having functional groups with the monomers necessary for preparing the above polymers.

12. An electrophotographic photoreceptor according to claim 7, wherein an under-coating layer is provided between said conductive support and said charge-generating layer, and said under-coating layer comprises a material selected from the group consisting of an aluminum anodic oxide film, polyvinyl alcohol, polyvinylbutyral, polyvinylpyrrolidone, polyacrylic acid, celluloses, gelatins, starches, polyurethanes, polyimides, casein, N-methoxymethylated nylon and mixtures thereof.

13. An electrophotographic photoreceptor according to claim 7, wherein said charge-generating layer has 0.05 to 5 μm thick.

14. An electrophotographic photoreceptor according to claim 7, wherein said charge-transporting layer has 5 to 50 μm thick.

15. A process for producing an electrophotographic photoreceptor, comprising the steps of:

dipping a conductive support in a solution for a photoconductive layer containing a charge-generating material, a binder resin having no or one glass transition point and a solvent;

pulling up the conductive support from said solution; and drying the conductive support to remove the solvent from the solution covering the surface of the support, thereby forming the photoconductive layer;

said binder being selected from the group consisting of polyarylate, polyether ketone, epoxy resins, urethane resins, cellulose ethers, copolymers obtained by polymerizing monomers necessary for preparing the above polymers, polyester resins, acrylic resins and copolymers obtained by polymerizing functional monomers having functional groups with the monomers necessary for preparing the above polymers.

16. The process for producing an electrophotographic photoreceptor according to claim 15, wherein said binder resin is dissolved in said solvent in a proportion falling in a range of 5 to 17 weight % based on the solvent.

17. The process for producing an electrophotographic photoreceptor according to claim 16, wherein said binder resin comprises at least two polymers selected from the group consisting of polycarbonate, polyarylate, polyether ketone, epoxy resins, urethane resins, cellulose ethers, copolymers obtained by polymerizing monomers necessary for preparing the above polymers, polyester resins, acrylic resins and copolymers obtained by polymerizing functional monomers having functional groups with the monomers necessary for preparing the above polymers.

18. The process for producing an electrophotographic photoreceptor according to claim 15, wherein said charge-generating material comprises: an inorganic photoconductive material selected from the group consisting of selenium, selenium alloys, arsenic-selenium, cadmium sulfide, zinc oxide, amorphous silicon and mixtures thereof; an organic pigment selected from the group consisting of phthalocyanines, azo compounds, quinacridone, polycyclic quinones, perylene and mixtures thereof; or an organic dye selected from the group consisting of thiapyrylium salts, squalilium salts and mixtures thereof.

19. A process for producing an electrophotographic photoreceptor, comprising the steps of:

dipping a conductive support having a charge-generating layer containing a charge-generating material on the surface of the support in a solution for a charge-transporting layer containing a charge-transporting material, a binder resin having no or one glass transition point and a solvent;

pulling up the conductive support from said solution; and drying the conductive support to remove the solvent from the solution covering the surface of the charge-generating layer formed on said support, thereby forming the charge-transporting layer;

said binder being selected from the group consisting of polyarylate, polyether ketone, epoxy resins, urethane resins, cellulose ethers, copolymers obtained by polymerizing monomers necessary for preparing the above polymers, polyester resins, acrylic resins and copolymers obtained by polymerizing functional monomers having functional groups with the monomers necessary for preparing the above polymers.

20. The process for producing an electrophotographic photoreceptor according to claim 19, wherein said binder resin is dissolved in said solvent in a proportion falling in a range of 5 to 17 weight % based on the solvent.

21. The process for producing an electrophotographic photoreceptor according to claim 20, wherein said binder resin comprises at least two polymers selected from the group consisting of polycarbonate, polyarylate, polyether ketone, epoxy resins, urethane resins, cellulose ethers, copolymers obtained by polymerizing monomers necessary for preparing the above polymers, polyester resins, acrylic resins and copolymers obtained by polymerizing functional monomers having functional groups with the monomers necessary for preparing the above polymers.

22. The process for producing an electrophotographic photoreceptor according to claim 19, wherein said charge-transporting material comprises: a high molecular compound selected from the group consisting of polyvinylcarbazole, polysilane and mixtures thereof; or a low molecular compound selected from the group consisting of hydrazone compounds, pyrazoline compounds, oxadiazole compounds, stilbene compounds, triphenylmethane compounds, triphenylamine compounds, enamine compounds and mixtures thereof.

* * * * *